US005472167A

United States Patent [19]

Shillington et al.

[11] Patent Number: 5,472,167

[45] Date of Patent: Dec. 5, 1995

[54] SECURE MOUNTING BRACKET FOR DISPOSABLE SHARPS CONTAINER

[75] Inventors: Richard A. Shillington, Leucadia; Gilbert Packer, Oceanside, both of Calif.

[73] Assignee: Med-Safe Systems, Inc., Oceanside, Calif.

[21] Appl. No.: 188,047

[22] Filed: Jan. 26, 1994

[51] Int. Cl.[6] ..... A47K 1/08

[52] U.S. Cl. ..... 248/552; 211/94; 248/311.2; 248/221.11

[58] Field of Search ..... 248/551, 552, 248/222.1, 311.2; 211/94, 94.5

[56] References Cited

U.S. PATENT DOCUMENTS

| | | | |
|---|---|---|---|
| 3,104,860 | 9/1963 | Brittian | 248/552 |
| 3,188,034 | 6/1965 | Jackson | 248/552 |
| 4,646,211 | 2/1987 | Gallant et al. . | |
| 4,736,860 | 4/1988 | Bemis . | |
| 4,869,378 | 9/1989 | Miller | 211/94 |
| 4,971,281 | 11/1990 | Steinbeck | 248/222.1 X |
| 5,009,381 | 4/1991 | Hermanson | 248/222.1 X |
| 5,350,150 | 9/1994 | Fiore | 248/552 |

FOREIGN PATENT DOCUMENTS

| | | | |
|---|---|---|---|
| 1188778 | 3/1965 | Germany | 248/222.1 |

*Primary Examiner*—Ramon O. Ramirez
*Assistant Examiner*—Derek J. Berger
*Attorney, Agent, or Firm*—Baker, Maxham, Jester & Meador

[57] ABSTRACT

A secure mounting bracket assembly for detachably mounting articles to a horizontal rail of a rail system, comprises a mounting panel having a front face and a back face, upper and lower relatively moveable hooks on said back of said panel for releasably hooking over an upper edge and under a lower edge of the horizontal rail, and a latch lever extending outward from and accessible from the front face of the panel for moving the lower hook for selectively latching to and releasing from the rail, and an upper edge of the panel extends into a slot on the back of an article for lockably mounting the article on the front face of the panel in a position for covering and preventing access to the latch lever.

20 Claims, 3 Drawing Sheets

SECURE MOUNTING BRACKET FOR DISPOSABLE SHARPS CONTAINER

BACKGROUND OF THE INVENTION

The present invention relates to disposable containers for hospital sharps and waste, and pertains particularly to a secure mounting assembly for disposable containers for disposition of hospital sharps, objects and wastes.

Hospitals and medical clinics use great quantities of sharps, such as needles, syringes, surgical blades, and the like, that are disposed of rather than cleaned and reused. It is necessary that the sharps be disposed of in a manner that prevents them being reused without sterilization. In particular, it is necessary to keep them from falling into the hands of those, such as intravenous drug users and the like, who are likely to use them without proper sterilization.

Numerous containers have been developed in recent years, which are reasonably secure and disposable for receiving and disposing of hospital sharps, wastes and the like. While improved containers have been developed which cannot readily be reopened and articles cannot be easily removed therefrom, such containers must be kept in a secure place or securely mounted to non-removable structure to prevent unauthorized removal. The disposable container and its mounting bracket must not only be secure, it must be simple and inexpensive to manufacturer, and it must be simple and easy to use and to mount and remove the container.

Reasonably secure mounting brackets have been recently developed and are widely used to prevent unauthorized removal of the containers. An example is disclosed in U.S. Pat. No. 5,103,997 issued Apr. 4, 1992 and assigned to the Assignee hereof. However, these type brackets are typically mounted on walls or similar surfaces and are securely anchored by lag bolts and the like. The installation of a new bracket normally requires the services of a skilled workman with special tools.

Many hospitals and clinics have begun using service outlet wall and rail systems such as disclosed in U.S. Pat. No. 4,646,211 issued Feb. 24, 1987 to Gallant et al. to provide convenient facilities for patient monitoring and treatment instruments and equipment. These rail systems provide convenient mounting for various instruments and equipment and service connections for these for patient treatment and monitoring.

It is, therefore, desirable that an improved secure mounting bracket assembly for disposable containers be available for mounting to existing rail systems.

SUMMARY AND OBJECTS OF THE INVENTION

It is the primary object of the present invention to provide an improved securable disposable container bracket assembly.

In accordance with a primary aspect of the present invention, a secure disposable container assembly comprises a bracket for securely and detachably mounting to a support rail system. Means are provided for easily and quickly locking the container to a support bracket to prevent removal of the container and to prevent removal of the bracket from the support rail.

BRIEF DESCRIPTION OF THE DRAWING

The above and other objects and advantages of the present invention will become apparent from the following description when read in conjunction with the accompanying drawings wherein.

DETAILED DESCRIPTION OF PREFERRED EMBODIMENTS

Figure 1:
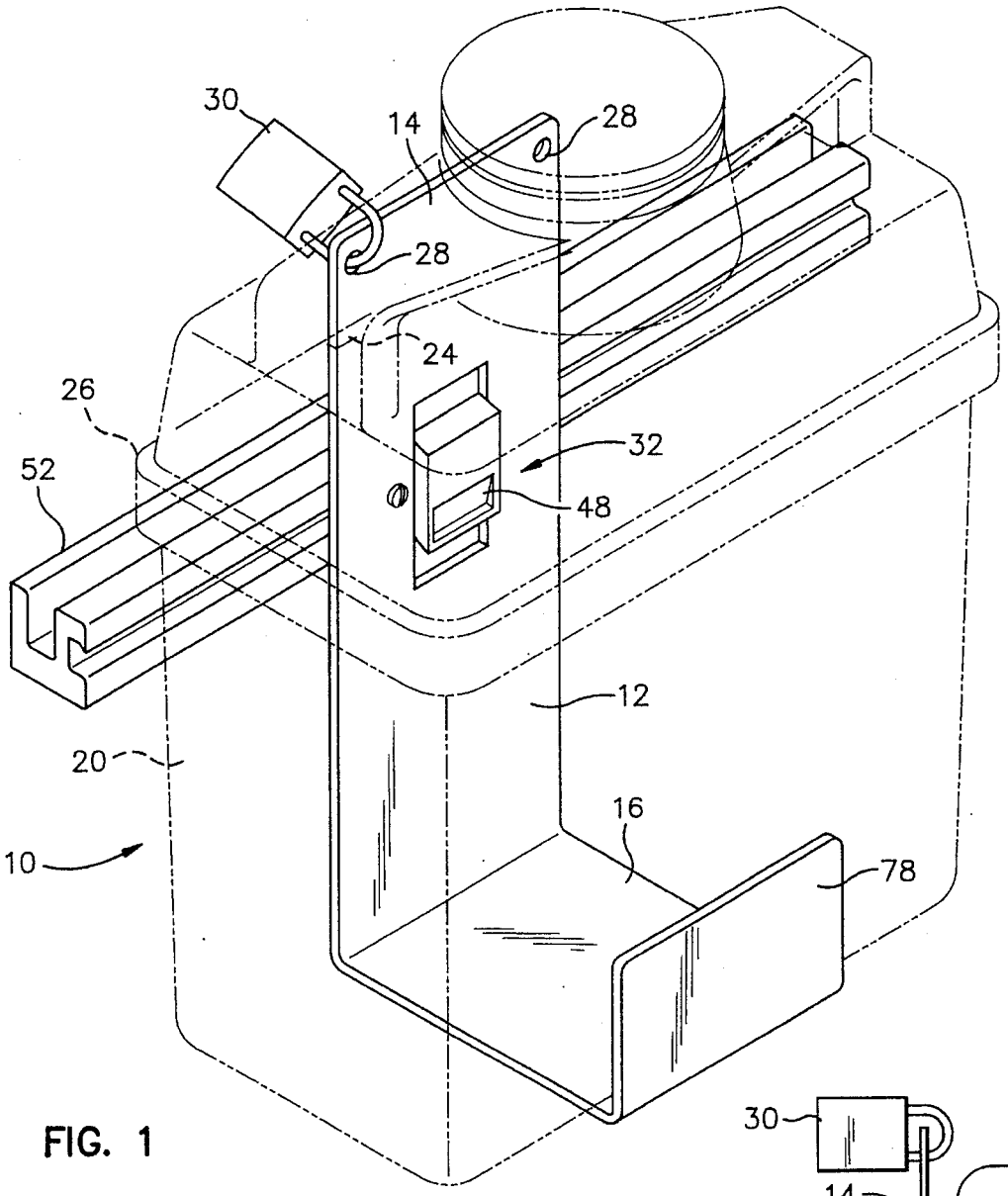
FIG. 1 is a perspective view of an exemplary embodiment of the invention.

Referring to FIG. 1 of the drawing, there is illustrated an exemplary embodiment of a disposable sharps container mounting bracket assembly in accordance with the invention, designated generally by the numeral 10. The container (shown in phantom) comprises a generally rectangular box-like housing, formed of the usual plastic material for such containers, and detachably mounted to the mounting bracket.

The overall bracket assembly comprises a primary bracket member which in the illustrated embodiment comprises a generally rectangular panel 12 having an upper end or edge portion 14 and a lower foot or hook portion including an outwardly extending foot 16 in an upwardly extending hook portion 18. The bracket is designed to receive or mount an article such as a disposable container 20 for example (shown in phantom) to a horizontally extending support rail 22. The bracket receives and mounts a container for example by the upper end portion 14 extending through a downwardly open slot 24 formed in a rim or shoulder 26 around the container. The downwardly directed slot or opening can be formed in any outwardly projecting portion on the back of the container or article to be mounted. The lower portion of the article or container in the illustrated embodiment is captured and retained by the lower hook assembly comprising the foot 16 and hook 18 which extends upwardly along a front of the container. The container, in the illustrated embodiment, rests on the foot portion 16 and the hook portion 18 extends upward along the front surface of the container to prevent outward pivoting of the container. The bracket includes one or more lock receiving bores or apertures 28 at the upper end for receiving a traditional padlock 30. This locks the container or other article to the bracket to prevent its removal.

Figure 2:
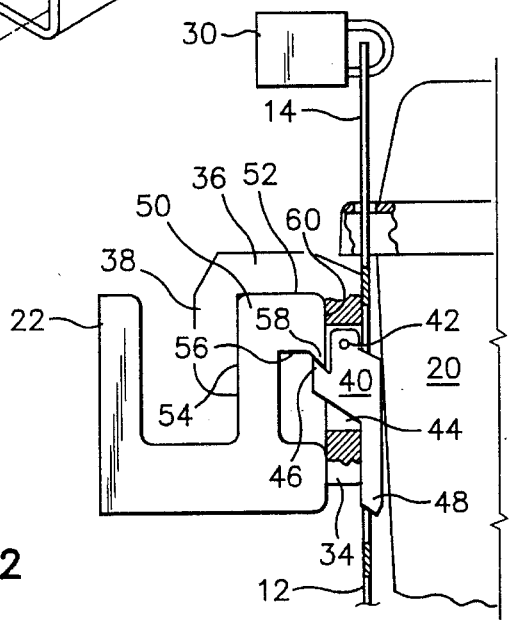
FIG. 2 is a detailed view of a portion of the bracket of FIG. 1 showing details of the mounting latch.
Figure 3:
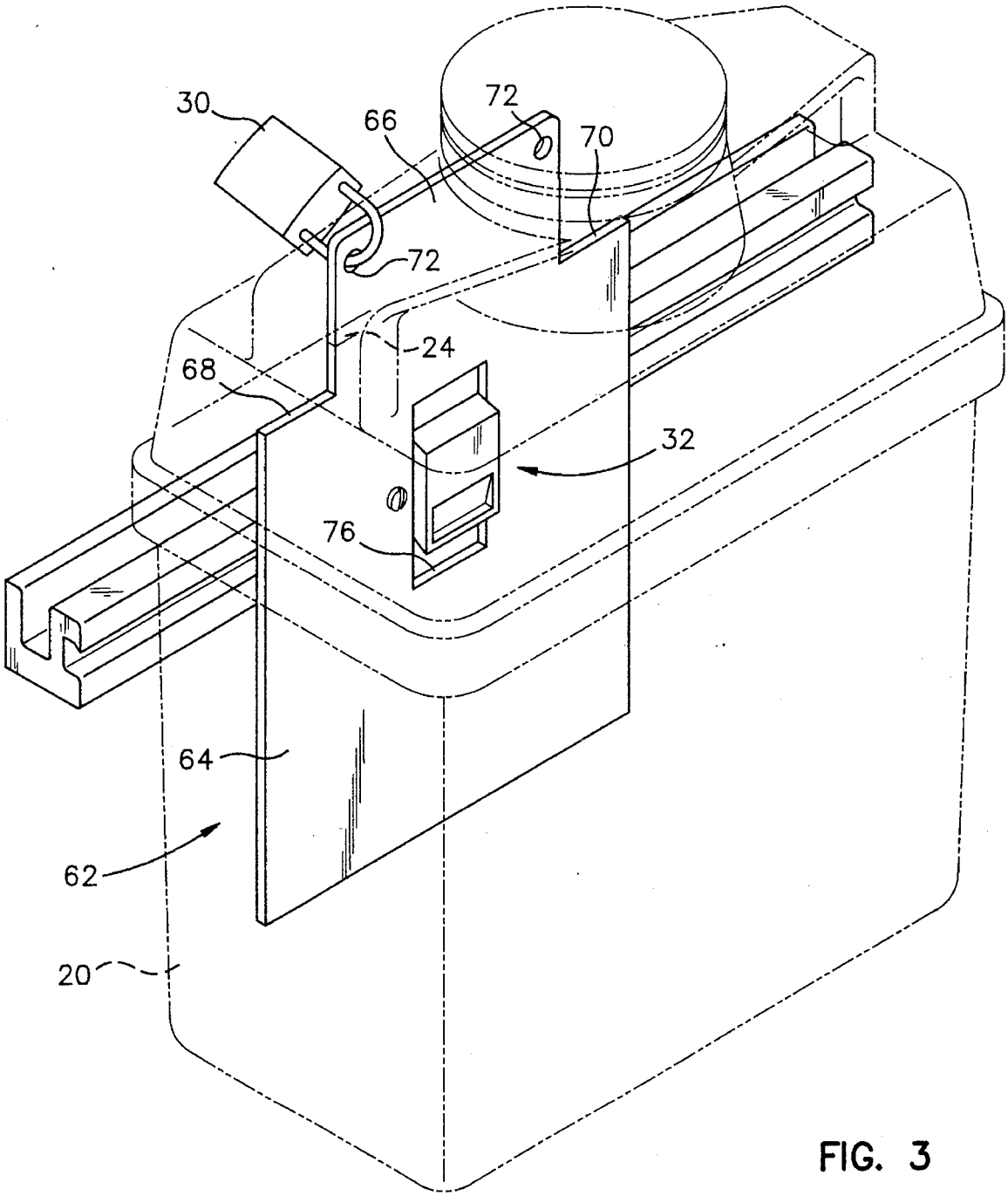
FIG. 3 is a view like FIG. 1 showing an alternate embodiment.

The illustrated assembly includes a releasable latch assembly designed generally at 32. The releasable latch assembly, as best illustrated in FIG. 2, comprises a base member 34 having an upper fixed hook defined by an outer extending member 36 and a downwardly extending member 38. A lower moveable hook or latch member 40 is pivotally mounted by means of a pin 42 within a rectangular through bore or aperture 44 in the body member 34. The moveable hook or latch member 40 includes a upwardly extending lower hook element 46 and a latch handle 48 for manually pivoting the member 40 about the pivot pin 42 to position hook element 6 into and out of a latched position with rail 50. The overall latch assembly is of a type available from the Hill-Rom Company, Inc., Batesville, Id. for detachable mounting of articles on rails of wall units such as disclosed in U.S. Pat. No. 4,646,211 granted Feb. 4, 1987 to Gallant, et al. That patent is incorporated herein by reference as though fully set forth.

The illustrated mounting bracket is designed to mount articles on horizontally extending rail members mounted on wall systems such that in the above patent. In the illustrated embodiment a rail 50 of the rail system 22 has a somewhat rectangular configuration with an upper surface 52 a back side or surface 54 and a bottom surface 56 with preferably a downwardly extending lip 58. The latch assembly has an upper fixed hook portion 36 and 38 which hooks over the top and back side of the rail 50 with the moveable hook portion 46 extending into an engagement with a lower surface 56 and preferably behind a downwardly extending lip 58 of the rail.

The latch assembly in combination With the bracket wherein an article such as container 20 is mounted on the bracket in a position to eliminate access to the latch release handle 48 provides a secure mounting assembly. Once the container 20 is locked to bracket portion 14 as illustrated, the latch release handle 48 is inaccessible and the bracket is thus locked to the rail 50. This provides a secure and easily mountable bracket assembly for mounting containers and other useful articles to a wall system in a hospital or clinic service and operating rooms. Other articles such as monitoring instruments, infusion pumps and the like may also be similarly mounted with the subject bracket assembly with little or no modification.

Figure 4:
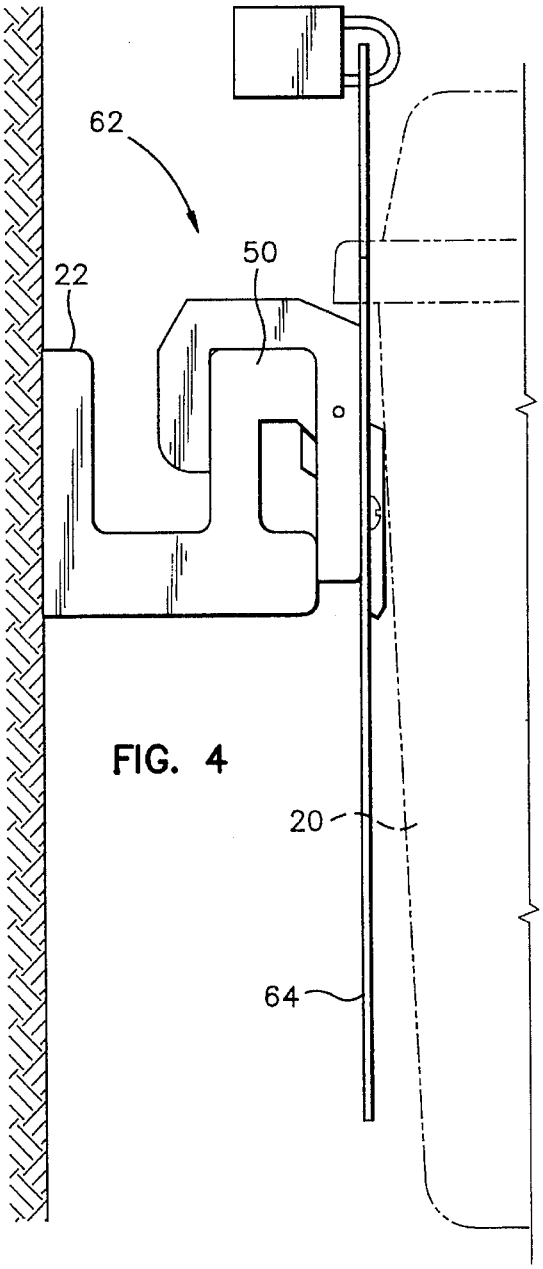
FIG. 4 is a side elevation view of the embodiment of FIG. 3.

Referring to FIG. 4, an alternate embodiment is illustrated wherein the mounting bracket designed generally at 62 comprises a panel 64 of a generally rectangular configuration with a stepped in upper extending portion 66 defining shoulders 68 and 70. The shoulders 68 and 70 provide stops that engage rim or shoulder 26 to prevent the panel from slipping through the slot 24. The upper extending portion 66 extends through slot 24 in the container and has lock receiving bores or apertures 72 as in the previous embodiment to lock the container to it. A padlock 30 may be mounted in either of the apertures or bores 70 to lock the container to the panel. A releasable latch assembly designed generally at 74 is mounted in a generally rectangular opening 76 in the mid-portion of the panel. The mounting bracket 62 may then be releasably mounted to a rail 50 as shown in FIG. 4 and is then locked to the mounting rail by lockably mounting the container or other article to the front surface of the bracket 64. The container 20 as in the previous embodiment prevents access to the release lever 48 of the releasable latch assembly. Thus, the container 20 is locked to the support rail 50.

Figure 5:
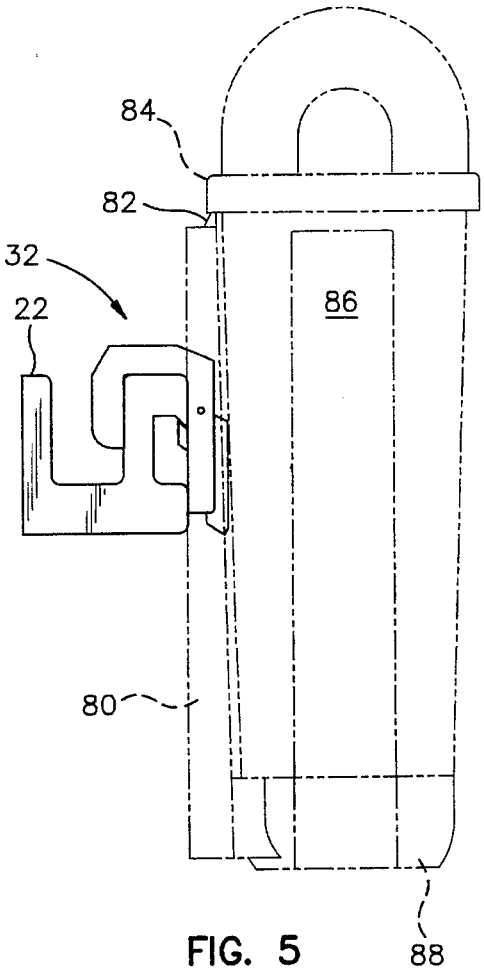
FIG. 5 is a detailed partial view of the latching apparatus for the container shown in the unlatched condition.

Referring to FIG. 5, an alternate embodiment is illustrated wherein the releasable latch assembly 32 is mounted to a back panel 80 of a bracket assembly such as that disclosed in Applicant's U.S. Pat. No. 5,103,997 issued Apr. 4, 1992 and assigned to the Assignee hereof. That patent is incorporated herein by reference as though fully set forth. The mounting bracket as disclosed in that patent includes a generally planar rectangular panel 80 having an upper edge 82 that extends under a rim 84 of the container 86. A lock housing 88 is secured to the lower end of the panel 80 and contains a lockable latch lever that engages a tab on the lower end of the container 86 for locking it to the mounting bracket. The mounting of the latch assembly 32 in an aperture or opening in the back panel 80 of the mounting bracket of the aforesaid patent results in a structure in accordance with the invention wherein the locking of the container to its mounting bracket covers the latch release lever 48. This effectively locks the mounting bracket to the support rail assembly and prevents unauthorized removal.

In operation, a releasable latch assembly 32 is mounted to a mounting bracket which mounts an article in a position to cover the latch release handle or lever of the latch assembly. This provides a mounting bracket assembly which may be quickly and easily lockably attached to a horizontally extending mounting rail.

While we have illustrated and described our invention by means of specific embodiments, it is to be understood that numerous changes and modifications may be made therein without departing from the spirit and scope of the invention as defined in the appended claims.

We claim:

1. A secure mounting bracket assembly for detachably mounting selected articles to a support structure, comprising:

a mounting panel having a front face and a back face;

first attaching means extending from said back face for releasable attachment to a support structure, said first attaching means comprising upper and lower relatively moveable hook means on said back of said panel for releasably hooking over and behind an upper edge and for hooking under and behind a lower edge of the support structure, and a latch lever extending outward from and accessible from the front face of said panel for moving one of said upper and lower hook means for selectively latching to and releasing from said support structure; and second attaching means including locking means on the front face of said mounting panel for lockably mounting a selected article on said front face in a position for covering and preventing access to said latch lever.

2. A mounting bracket according to claim 1, wherein said second attaching means comprises an upper extended edge on said mounting panel for extending through a slot in structure on the article for receiving said locking means for preventing removal of said upper edge from said slot.

3. A secure mountain bracket according to claim 2, wherein:

said upper edge includes an aperture therethrough; and said locking means includes a padlock for extending into and locking in said aperture.

4. A mounting bracket according to claim 3, wherein said second attaching means includes means at a bottom of said panel for engaging a lower portion of the article for constraining movement relative to said panel.

5. A mounting bracket according to claim 4 wherein said means for engaging a lower portion of the article comprises a hook at the bottom of said panel for extending over a front portion of said article.

6. A mounting bracket according to claim 5 in combination with the article wherein said article is a disposable sharps container.

7. A mounting bracket according to claim 1 in combination with the article wherein said article is a disposable sharps container.

8. A mounting bracket to claim 1 wherein said mounting panel includes a housing at the bottom of said panel; and said second attaching means comprises a lever mounted in said housing for pivoting toward and away from said panel for latching said container to said bracket.

9. A mounting bracket according to claim 8 wherein said first attaching means extends outward from the back face of said mounting panel, said upper hook means is fixed and said lower hook means is moveable and is on an end of said latch lever so that movement of said latch lever outward from said front face releases said lower hook means from behind the support structure and movement toward said face positions said lower hook in said latched position behind said support structure.

10. A mounting bracket according to claim 1 wherein:

said first attaching means is mounted on the back face of said mounting bracket, said upper hook means is fixed and said lower hook means is moveable and is on an end of said latch lever so that movement of said latch lever outward from said front face release said lower hook means from behind the support structure and movement toward said face positions said lower hook in said latched position behind said support structure.

11. A combination detachable mounting bracket and elongated horizontal support rail assembly for detachably mounting an article to said horizontal rail of a wall system, comprising:

an elongated horizontal support rail;

A mounting panel having a front face and aback face;

first releasable attaching means extending from said back face for releasable attachment to said horizontal support rail, said first attaching means comprising an upper hook for hooking over and behind an upper edge of said support rail and a lower moveable hook on said back of said panel for releasably hooking under and behind a lower edge of said support rail, and a latch lever extending outward from and accessible from the front face of said panel for moving said lower hook for selectively latching to and releasing from said rail; and second attaching means including locking means on the front face of said mounting panel for lockably mounting an article on said front face in a position for covering and preventing access to said latch lever.

12. A combination mounting bracket according to claim 11, wherein said second attaching means comprises an upper extended edge on said mounting panel for extending through a slot in structure on the article for receiving said locking means for preventing removal of said upper edge from said slot.

13. A secure combination according to claim 12, wherein:

said upper edge includes an aperture therethrough; and said locking means includes a padlock for extending into and locking in said aperture.

14. A combination according to claim 13, wherein said second attaching means includes hook means defined by a forwardly extending foot and an upwardly extending hook at a bottom of said panel for extending in front of and engaging a lower portion of said article for constraining movement relative to said panel.

15. A combination according to claim 14 in combination with the article wherein said article is a disposable sharps container.

16. A combination according to claim 13, wherein said second attaching means includes hook means defined by a forwardly extending foot and an upwardly extending panel at an outer end of said foot for engaging behind a lower portion of said container for constraining movement relative to said panel.

17. A secure combination according to claim 12, wherein:

said upper edge includes an aperture therethrough; and said locking means includes a padlock for extending into and locking in said aperture.

18. A combination according to claim 11 in combination with the article wherein said article is a disposable sharps container.

19. A combination to claim 11 wherein:

said mounting panel includes a housing at the bottom of said panel; and said second attaching means comprises a lever mounted in said housing for pivoting toward and away from said panel for latching said container to said bracket.

20. A detachable mounting bracket for detachably mounting a disposable container to a horizontal rail of a wall system, comprising:

a disposable container;

a generally rectangular mounting panel having a substantially planar front face and a substantially planar back face;

first releasable attaching means extending from said back face for releasable attachment to said horizontal support rail, said first attaching means comprising an upper hook for hooking over and behind an upper edge of said support rail and a lower moveable hook for releasably hooking under and behind a lower edge of the support rail, and a latch lever extending outward from and accessible from the front face of said panel for moving said lower hook for selectively latching to and releasing from said rail; and second attaching means including locking means on the front face of said mounting panel for lockably mounting said disposable container on said front face in a position for covering and blocking access to said latch lever;

said attaching means comprises an upper extended edge on said mounting panel; and a slot on said article for receiving said upper extended edge, and locking means for preventing removal of said upper edge from said slot.

* * * * *